US007128492B1

(12) United States Patent
Thames, Jr.

(10) Patent No.: US 7,128,492 B1
(45) Date of Patent: Oct. 31, 2006

(54) TOOTHPASTE DISPENSING TOOTHBRUSH

(76) Inventor: William Thames, Jr., 8111 Kenwood Dr., Norfolk, VA (US) 23518

( * ) Notice: Subject to any disclaimer, the term of this patent is extended or adjusted under 35 U.S.C. 154(b) by 0 days.

(21) Appl. No.: 11/254,259

(22) Filed: Oct. 19, 2005

(51) Int. Cl.
*A46B 11/06* (2006.01)
*A46B 11/04* (2006.01)

(52) U.S. Cl. ..... 401/289; 401/282; 401/270

(58) Field of Classification Search ..... 401/183–186, 401/270, 278, 289, 282
See application file for complete search history.

(56) References Cited

U.S. PATENT DOCUMENTS

| | | | | |
|---|---|---|---|---|
| 1,859,402 | A | 5/1932 | Maher | |
| D127,731 | S | 6/1941 | Bergman | |
| 2,527,741 | A | 10/1950 | Lamonde | |
| 3,408,150 | A | 10/1968 | Figa | |
| 3,653,778 | A * | 4/1972 | Freiling | 401/183 |
| 3,712,747 | A | 1/1973 | Drohomirecky | |
| 4,049,354 | A * | 9/1977 | O'Rourke | 401/134 |
| 4,221,492 | A * | 9/1980 | Boscardin et al. | 401/184 |
| 4,622,984 | A | 11/1986 | Gaebel | |
| 4,691,718 | A | 9/1987 | Sakuma et al. | |
| 4,957,125 | A | 9/1990 | Yaneza | |
| 5,028,158 | A | 7/1991 | Fey | |
| D322,172 | S | 12/1991 | Cheng | |
| 5,425,591 | A | 6/1995 | Contreras et al. | |
| 5,827,001 | A | 10/1998 | Taghavi-Khanghah | |
| 6,056,466 | A * | 5/2000 | Johnson et al. | 401/188 R |
| 6,672,783 | B1 * | 1/2004 | Licata et al. | 401/123 |
| 6,679,642 | B1 * | 1/2004 | Dillingham et al. | 401/184 |

* cited by examiner

*Primary Examiner*—David J. Walczak

(57) ABSTRACT

A toothpaste dispensing toothbrush includes a toothpaste reservoir in the handle of the toothbrush. A filling port is defined through the aft end of the handle and screw threads are defined on the handle adjacent to the filling port. The screw threads threadably connect to screw threads on the outlet element of a toothpaste tube so the toothpaste tube can be threadably connected to the toothbrush for a filling or a refilling operation.

2 Claims, 1 Drawing Sheet

TOOTHPASTE DISPENSING TOOTHBRUSH

FIELD OF THE INVENTION

The present invention relates to the general art of toothbrushes, and to the particular field of toothbrushes which dispense toothpaste onto the bristles from a toothpaste reservoir in the toothbrush.

BACKGROUND OF THE INVENTION

Current toothbrushes are commonly one of two different types. The first type requires the user to dispense a quantity of toothpaste from a tube or container onto the bristles of the toothbrush. Such an arrangement requires the provision of separate containers and toothbrushes, and the step of charging the toothbrush with toothpaste from the container prior to use, which can be a messy and time-consuming operation.

The second type of toothbrush incorporates its own container of toothpaste, usually in or as the handle of the toothbrush. The container, once empty, can either be refilled or replaced. However, such arrangements suffer from a number of disadvantages, not the least of which is that the overall toothbrush is of relatively complex construction and is therefore expensive to manufacture. Furthermore, operation of the toothbrush may require the actuation and/or manipulation of several different elements within the system. This may be especially difficult for a disabled person or a child.

Toothbrushes of the second type also afford another advantage over toothbrushes of the first type in that the time required to dispense toothpaste onto the bristles is reduced since it is not necessary to uncap and recap the toothpaste cartridge as is required when using toothbrushes of the first type. In addition, preparation for travel is simplified in that a single unit includes both the toothbrush and the toothpaste.

However, presently-available toothbrushes of the second type have a disadvantage in that when the toothpaste stored therein is used up, it may be difficult or messy to refill the toothbrush. Often, a user will simply discard the toothbrush rather than refill it. This may be wasteful and expensive. Therefore, there is a need for a toothbrush which incorporates its own supply of toothpaste and which is easy to operate and easy to refill.

SUMMARY OF THE INVENTION

The above-discussed disadvantages of the prior art are overcome by a toothpaste dispensing toothbrush which includes a toothpaste reservoir in the handle thereof and which has a toothpaste inlet port on an aft end of the handle. A screwthread is defined on the handle adjacent to the inlet port and which is sized and adapted to threadably accommodate the toothpaste outlet of a toothpaste tube whereby toothpaste from the toothpaste tube can flow directly into the toothbrush reservoir from the toothpaste tube without danger of spilling or missing the inlet port. A finger operated control element on the handle of the toothbrush is connected to a mechanism in the handle which forces toothpaste from the reservoir in the handle into a passage that connects the reservoir in the handle to outlet ports adjacent to the bristles whereby toothpaste forced out of the reservoir flows directly onto the bristles when the control element is operated.

Using the toothpaste dispensing toothbrush embodying the present invention will permit a user to quickly and easily fill and refill the reservoir of the toothpaste with little or now spilling of the toothpaste. The filling or refilling operation is easy and requires only a minimum of manipulation so that a child or a disabled person can easily and efficiently fill or refill the toothbrush embodying the present invention.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
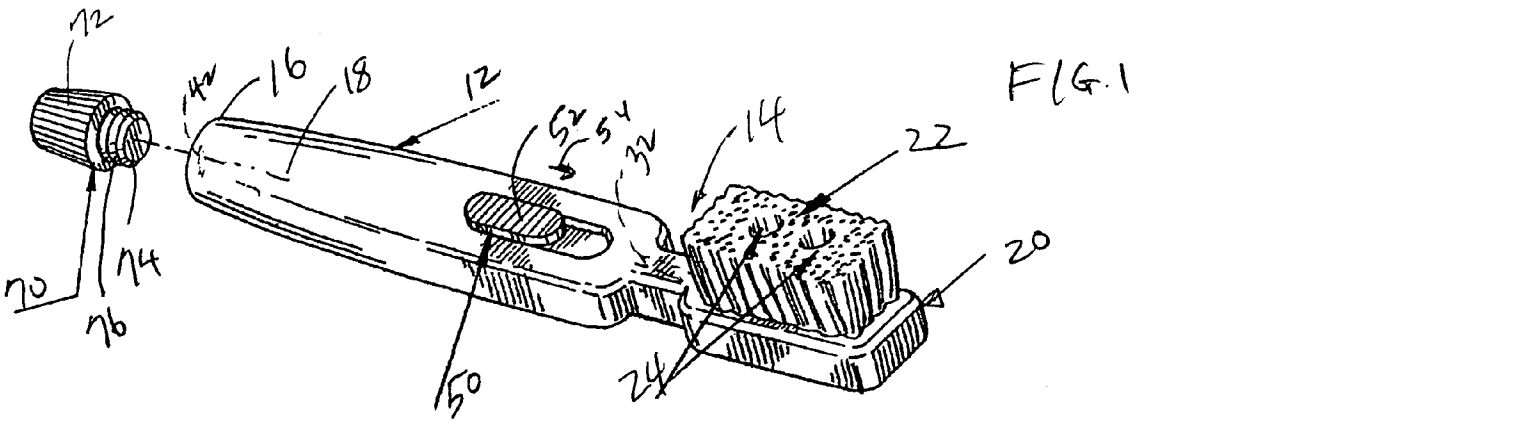
FIG. 1 is a perspective view of a toothpaste dispensing toothbrush embodying the present invention.
Figure 2:
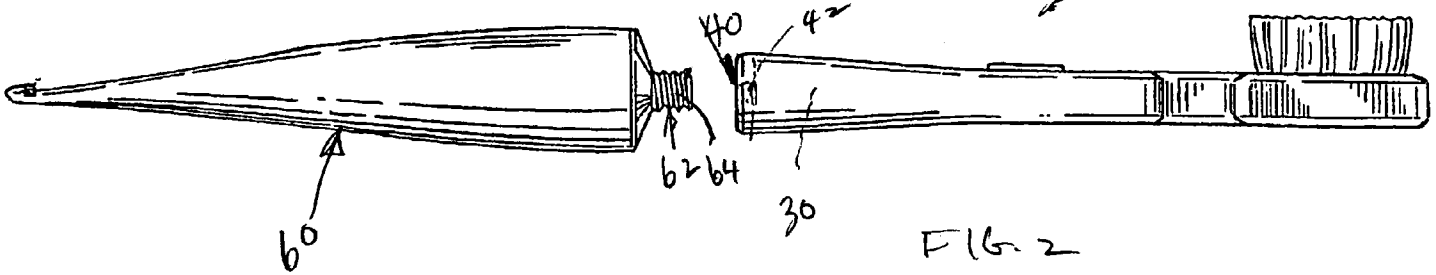
FIG. 2 is an elevational view of the toothpaste dispensing toothbrush embodying the present invention in combination with a toothpaste tube in position for refilling the reservoir of the toothbrush.
Figure 3:
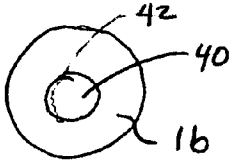
FIG. 3 is an end view of the toothpaste dispensing brush embodying the present invention and shows the toothpaste inlet port and the screw thread on the body of the toothbrush adjacent to the inlet port.

Referring to the figures, it can be understood that the present invention is embodied in a toothpaste dispensing toothbrush 10 which overcomes the above-described shortcomings of the prior art.

Toothbrush 10 comprises a one piece body 12 which includes a first end 14 which is a head end when body 12 is in use, a second end 16 which is an aft end when body 12 is in use and a longitudinal axis 18 which extends between first end 14 and second end 16. Body 12 can be formed of plastic or other suitable material.

A bristle-supporting head 20 is located on first end 14 and bristles 22 are mounted on bristle-supporting head 20. Two toothpaste dispensing ports 24 are defined in bristles 22. While two ports are shown, other numbers, including one port, can be used without departing from the scope of the present disclosure. Body 12 is hollow and a toothpaste reservoir 30 is defined in the body. A toothpaste conduit 32 connects toothpaste reservoir 30 to toothpaste dispensing ports 24 defined in bristles 22.

A toothpaste inlet port 40 is defined through second end 16 of the body and is in communication with toothpaste reservoir 30 defined in the body. A screw thread 42 is defined on second end 16 of body 12 adjacent to toothpaste inlet port 40. A control mechanism 50 is located on the body and is operably connected to toothpaste reservoir 30 to force toothpaste from the toothpaste reservoir onto the bristles via the toothpaste conduit and the toothpaste dispensing port when operated. Control mechanism 50 can include various elements, such as wedges, and plates located in the reservoir to force the toothpaste from the reservoir when a finger-operated element 52 is forced in direction 54. However, the exact details of control mechanism 50 are not important to the invention and those skilled in the art will be able to design a suitable control mechanism based on the teaching of the present disclosure. Accordingly, the details of control mechanism 50 will not be presented.

A toothpaste tube 60 contains toothpaste and has a toothpaste dispensing port 62 thereon out of which toothpaste flows when the toothpaste tube is squeezed as will be understood by those skilled in the art. Toothpaste tube 60 further includes a screw thread 64 defined on the dispensing port. Screw thread 42 defined on second end 16 of body 12 adjacent to toothpaste inlet port 40 is sized to threadably connect to screw thread 62 defined on the dispensing port of the toothpaste tube to operably connect the toothpaste tube to the body to dispense toothpaste from the toothpaste tube into reservoir 30 of the body when the toothpaste tube is squeezed after such operable connection between the toothpaste tube and the body has been effected.

A closure cap 70 includes a body 72 and a post 74 on body 72. A screw thread 76 is defined on the post. Screw thread 76 is sized and configured to threadably mate with screw thread 42 defined on second end 16 of body 12 adjacent to toothpaste inlet port 40 to close the toothpaste inlet port when closure cap 70 is threadably connected to the body.

Operation of toothpaste dispensing brush 10 can be understood from the teaching of the foregoing disclosure and thus will only be briefly discussed. Reservoir 30 is filled by threadably attaching toothpaste tube 60 to body 12 via inlet port 40 and the threaded connection established between threads 64 and 42. Toothpaste is dispensed from the tube and into the reservoir when tube 60 is squeezed. After reservoir 30 has been filled, the toothpaste tube is disconnected from body 12 and closure cap 70 is threadably connected to body 12 via threads 76 and 42 to close reservoir 30. When desired, mechanism 50 is operated to force toothpaste from reservoir 30 onto bristles 22 via conduit 32 and ports 24.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A toothpaste dispensing toothbrush consisting of:

A) a one piece body which includes (1) a first end which is a head end when the body is in use, (2) a second end which is an aft end when the body is in use, (3) a longitudinal axis which extends between the first end and the second end, (4) a bristle-supporting head on the first end, (5) bristles mounted on the bristle-supporting head, (6) a toothpaste dispensing port defined in the bristles, (7) a toothpaste reservoir defined in the body, and (9) a toothpaste conduit connecting the toothpaste reservoir to the toothpaste dispensing port defined in the bristles;

B) a toothpaste inlet port defined through the second end of the body and which is in communication with the toothpaste reservoir defined in the body;

C) screw thread defined on the second end of the body adjacent to the toothpaste inlet port;

D) a control mechanism on the body which is operably connected to the toothpaste reservoir to force toothpaste from the toothpaste reservoir onto the bristles via the toothpaste conduit and the toothpaste dispensing port when operated;

E) a toothpaste tube containing toothpaste and having a toothpaste dispensing port thereon out of which toothpaste flows when the toothpaste tube is squeezed, the toothpaste tube further including a screw thread defined on the dispensing port, with the screw thread defined on the second end of the body adjacent to the toothpaste inlet port being sized to threadably connect to the screw thread defined on the dispensing port of the toothpaste tube to operably connect the toothpaste tube to the body to dispense toothpaste from the toothpaste tube into the reservoir of the body when the toothpaste tube is squeezed after such operable connection between the toothpaste tube and the body; and F) a closure cap which includes (1) a body, (2) a post on the body of the closure cap, and (3) a screw thread on the post, the screw thread on the post being sized and configured to threadably mate with the screw thread defined on the second end of the body adjacent to the toothpaste inlet port to close the toothpaste inlet port when the closure cap is threadably connected to the body wherein said cap cannot exert a force on said toothpaste in said toothpaste reservoir after said cap has been attached to said body.

2. The toothpaste dispensing toothbrush of claim 1, where the control mechanism is located between the toothpaste reservoir and the toothpaste conduit.

* * * * *